United States Patent [19]

Moore

[11] 4,081,228

[45] Mar. 28, 1978

[54] APPARATUS FOR HOT BRIQUETTING

[76] Inventor: James E. Moore, 1401 Meadow La., Glenview, Ill. 60025

[21] Appl. No.: 789,629

[22] Filed: Apr. 21, 1977

[51] Int. Cl.[2] ..... F27B 7/00

[52] U.S. Cl. ..... 425/144; 425/237; 425/DIG. 20

[58] Field of Search ..... 425/143, 144, 222, 237, 425/DIG. 20

[56] References Cited

U.S. PATENT DOCUMENTS

| | | | |
|---|---|---|---|
| 2,675,304 | 4/1954 | Komarek | 425/237 X |
| 3,036,338 | 5/1962 | Nack | 425/DIG. 20 |
| 3,231,649 | 1/1966 | Pfeiffer | 425/DIG. 20 |
| 3,295,952 | 1/1967 | Johnson | 425/237 X |
| 3,328,843 | 7/1967 | Murphy et al. | 425/237 X |
| 3,339,227 | 9/1967 | Ehrenfreund | 425/144 |
| 3,366,717 | 1/1968 | Rohaus | 425/237 X |
| 3,450,529 | 6/1969 | MacDonald | 425/237 X |
| 3,627,288 | 12/1971 | MacDonald | 425/237 X |
| 3,698,844 | 10/1972 | Grimm | 425/144 |

*Primary Examiner*—J. Howard Flint, Jr.
*Attorney, Agent, or Firm*—Leydig, Voit, Osann, Mayer & Holt, Ltd.

[57] ABSTRACT

A system for heating and hot briquetting particulate matter containing a material that softens when heated, which consists of an improved fluid bed reactor for heating the material and certain instrumentation and controls for protecting the briquetting equipment from excessive temperatures originating in the furnace.

The furnace improvements permit the processing of feed material having wide ranges of particle size, density and fuel content over substantial ranges of production rates. Furnace constructions are provided for heating the materials at rates of 700,000 to 2,800,000 BTU per square foot of hearth area and avoiding problems normally associated with such high combustion rates, such as excessive entrainment of feed from the furnace by the off gas, surging of the bed and insufficient material available at the furnace outlet to meet the needs of the briquetting machine.

10 Claims, 5 Drawing Figures

66
68
35
63
36
67
37
64
65
FUEL
76
75
72
77
71
70
74
51
55
50
73
50a
15
10
12
56
57
59
20
84
43
81
80
82
44
24
45
25
83
DRIVE
40
DRIVE
60
30

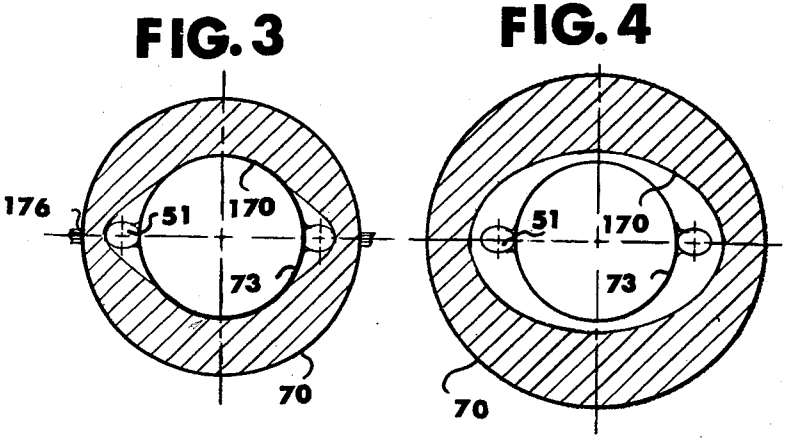
FIG. 4
FIG. 3
170
73
51
70
176
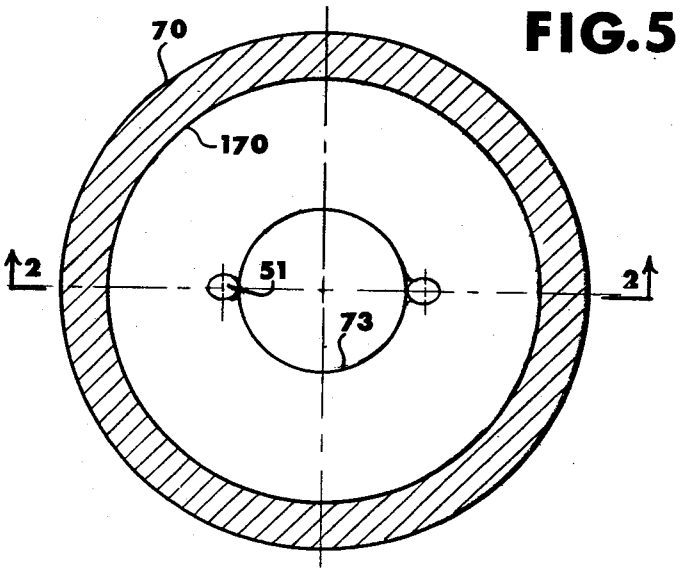
FIG. 5
2
2
70
170
51
73
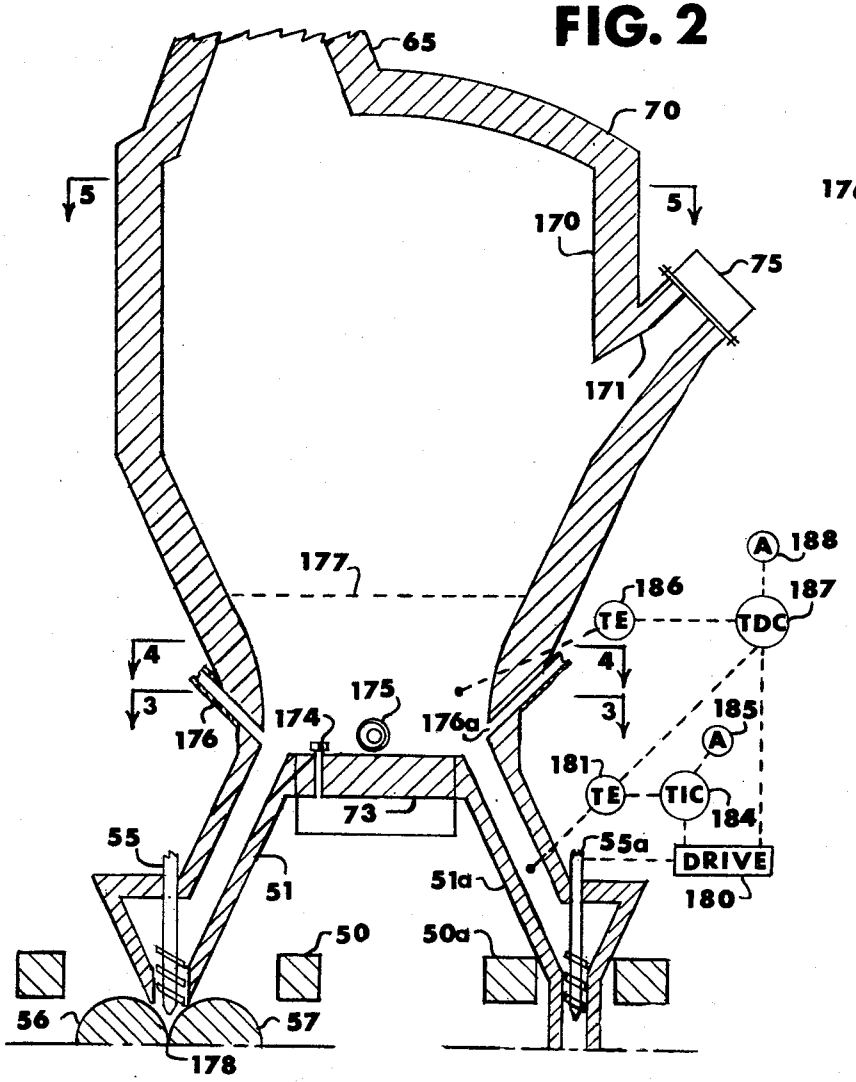
FIG. 2
65
70
170
171
75
5
5
177
174
175
176
176a
73
51
51a
50a
55
55a
50
57
56
178
4
3
4
3
181
186
TE
TE
185
A
188
A
187
TDC
184
TIC
180
DRIVE

APPARATUS FOR HOT BRIQUETTING

This invention relates to improvements in equipment and systems for heating and hot briquetting particulate matter and is especially useful in agglomerating mixtures of waste materials and screenings, such as those that are generated at a steel mill. Such materials are difficult to process because of their broad size range, which frequently varies from sub-micron to ⅜ inch size, and wide variations in specific gravity ranging from under 2 to above 5 and fuel value ranging from zero to several times that required for heating the material.

Fluid bed reactors are well suited to heating materials for hot briquetting, and roll-type compactors have been developed for briquetting the hot material. However, special measures are required, particularly when processing mixtures of waste materials, in order to avoid severe operating difficulties and damage to the component parts, such as fusion of the fluid bed furnace bed, stoppage of flow through the passageway from the furnace to the compactor and overheating of working parts, particularly the compactor rolls.

It is, accordingly, an object of the present invention to provide a fluidized bed furnace that has a configuration and a range of heating capacity that will enable it to process mixtures of materials varying widely in particle size and density, chemical composition and fuel value. It is a related object to provide a furnace that is capable of operating over a substantial range of throughput, so as to be able to operate at half capacity, as in a plant requiring two compacting machines for full production and with one out of order or when using only one compactor during start-up. It is another related object to provide a furnace that can operate at a constant temperature on a feed having an excess of fuel value and therefor requiring substantial variations in fluidizing air input so as to accommodate substantial variations in demand for heat when the feed rate and feed input temperature change, without loss of fluidization occurring at low air flow rates or excessive entrainment of feed materials from the furnace occurring at high rates.

It is another object of the present invention to provide a furnace configuration that will insure an adequate supply of feed to keep the feed conduit connecting the furnace outlet and the compactor inlet filled, so that fluidizing air is prevented from flowing into and overheating the compactor. It is a related object to provide ready access to the furnace outlet by coarse particles that would tend to accumulate within the bed and cause de-fluidization and by fine particles that would tend to blow out of the bed and be carried from the furnace by the off gas. It is another object to provide means for feeding extremely fine material directly into the bed at a point below the surface of the bed and near the outlet, so as to minimize entrainment from the bed.

It is another object of the invention to provide means for feeding combustible matter, solid, liquid or gaseous, into the furnace bed at a point near its outlet so that the feed will be at its highest temperature and most chemically reduced state as it is discharged to the compactor.

It is still another object of the invention to provide instrumentation and controls equipped to warn the operator of impending blockage or overheating of the passageway connecting the compactor to the furnace and to close the passageway before damage to the compactor parts can result.

Other objects and advantages of the invention will become apparent upon reading of the attached detailed description and upon reference to the drawings in which:

FIG. 2 shows an enlarged sectional view of portions of the furnace and the compactor into which the furnace discharges, looking along line 2—2 in FIG. 5, and shows schematically certain instrumentation and controls for protecting the compactor.

FIG. 3 shows a sectional view of the furnace at its bottom, looking along line 3—3 in FIG. 2.

FIG. 4 shows a sectional view of the furnace at an elevation above the outlet, looking along line 4—4 in FIG. 2.

FIG. 5 shows a sectional view of the furnace at an elevation near its top, looking along line 5—5 in FIG. 2.

Figure 1:
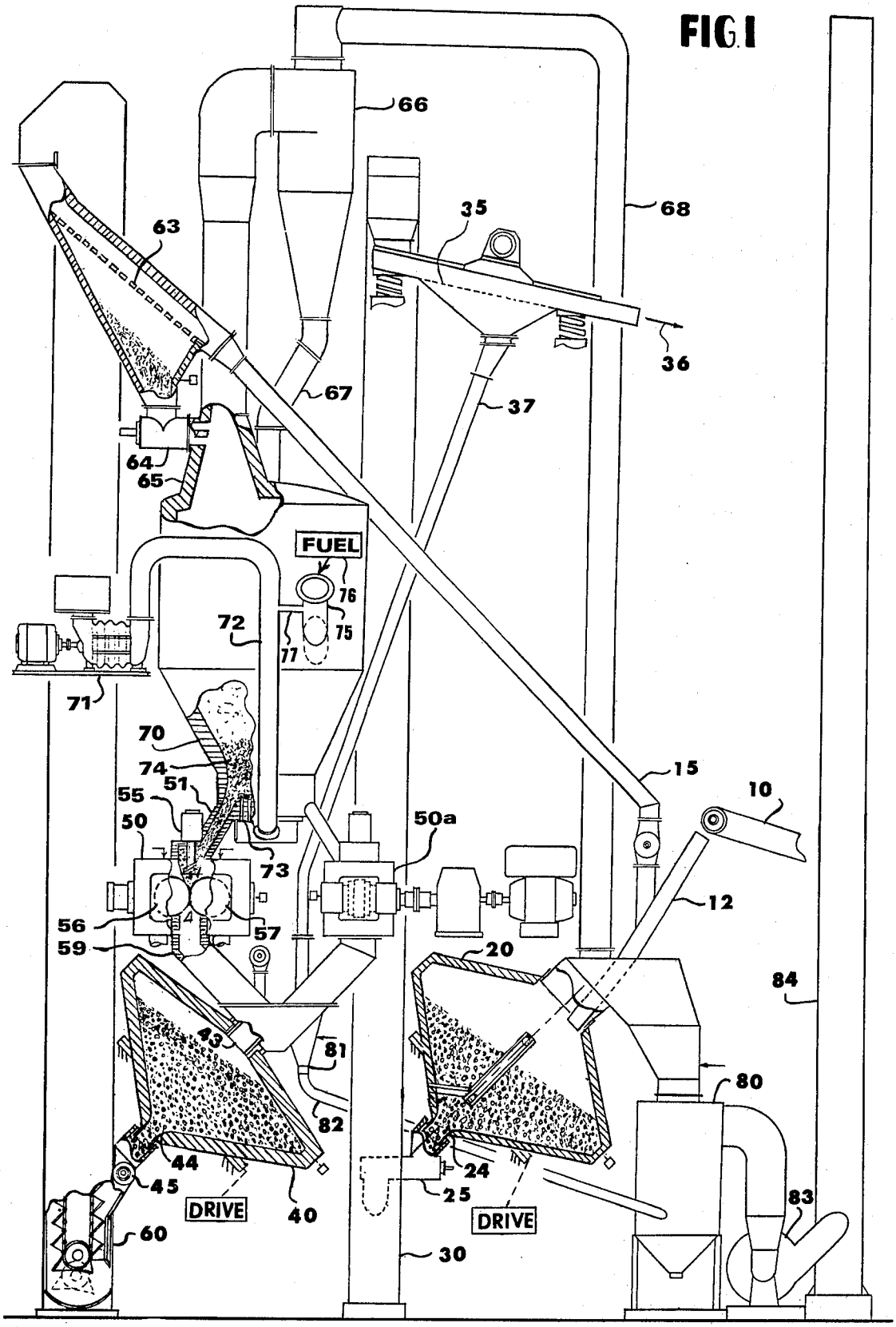
FIG. 1 is a schematic elevational view of a briquetting plant employing a furnace constructed in accordance with the invention, with the furnace being shown in vertical section.

While the invention has been described in accordance with certain preferred embodiments, it will be understood that I do not intend to be limited to the particular embodiments but intend, on the contrary, to cover the various alternative and equivalent forms of the invention included within the spirit and scope of the appended claims.

Turning now to FIG. 1, there is shown a hot briquetting plant, which is described in more detail in my copending application Ser. No. 788,639, filed Apr. 18, 1977 in which a furnace and a compactor corresponding to the present invention are illustrated. In this plant, feed from conveyor 10 and hot briquettes from chute 15 enter a tumbler-type heat exchanger 20 through its inlet 23 by way of chute 12. In this tumbler the two materials are mixed until they are at approximately the same temperature and then discharged through the tumbler outlet 24 by a feeder 25 and elevator 30 to screen 35. The briquettes 36 are discharged from the plant by the screen, while the feed material flows through chute 37 into a second heat exchange tumbler 40 by way of its inlet 43, where it is mixed with hot briquettes from compactors 50 and **50*a*. The two materials are mixed in the second tumbler until they reach substantially the same temperature and are then discharged through its outlet 44, feeder 45 and elevator 60 to screen 63. The briquettes are separated and fed through chute 15 to the first tumbler 20, and the fines are fed by feeder 64 to a feed/gas heat exchanger 65 and from there into the fluid bed furnace 70. The feed is heated in the furnace and discharged to the compactors 50 and 50*a*. Air for fluidization and combustion is supplied to the furnace by blower 71 through duct 72 and distributor 73 into the bed 74 of the furnace. The off gases from the furnace pass upward through the feed/gas heat exchanger 65, then through cyclone 66 for removal for entrained solids, which are returned to the furnace through conduit 67 containing a trickle valve (not shown). The off gas from the cyclone are carried by duct 68 into the scrubber 80. Off gas from tumbler 40 passes through scrubber 81 and a pipe 82 into scrubber 80. All gases from scrubber 80 are exhausted by fan 83, which discharges to atmosphere by way of stack 84**.

Turning attention more particularly to the furnace 70 and one of the compactors **50*a*, the furnace will be seen to have a burner 75 which is supplied with fuel 76 and air 77 from blower 71 which is used for preheating the furnace during start-up. When in operation, feed preheated in the furnace bed 74 passes through conduit 51 into compactor 50 at a rate determined by feeder 55 which regulates the rate at which feed enters the compactor rolls 56 and 57 which discharge via chute 59 into the tumbler 40**, mentioned previously.

The furnace and compactor are equipped with standard instrumentation and controls; for example, the furnace is equipped with known devices for injecting fuel and air into the bed, and the compactor is equipped with the usual drive and other standard features. The improvements forming the basis of the present invention are illustrated in FIGS. 2 and 5, to be next discussed.

FIG. 2 is a schematic vertical cross section view of the furnace and the two compactors shown in FIG. 1, with some features omitted and others added. The furnace 70 has a lining 170, a burner inlet 171, and a burner 175. The feed inlet and the gas outlet take place through gas/feed heat exchanger 65. The inlet air distributor 73 and one of the multiple-distribution tuyeres 174 are shown at the bottom of the furnace. The approximate average level of the bed 177 is indicated. Also indicated are a screw feeder 175 for injecting feed material or solid fuel into the bed and inlets 176 and **176*a* for introduction of gaseous or liquid fuel. The two feed outlets 51 and 51*a* are illustrated and the feed regulating devices 55 and 55*a* are also shown. The partial cross sectional views of the compactors 50 and 50*a* show portions of the frame of the compactor and of two of the rolls 56 and 57, above the nip 178**.

Instrumentation and controls for protecting the compactor from excessive temperatures are also shown schematically in FIG. 2. Temperature measuring element 181 senses the temperature in the furnace discharge chute **51*a*, and temperature indicating controller 184, coupled to temperature element 181, sounds an alarm 185 on high or low temperature. If the temperature in the furnace outlet 51*a* reaches a predetermined excessively high or low temperature, controller 184 stops the flow of feed from the furnace to the compactor by stopping drive 180, which operates the furnace feed regulator 55*a*. In another set of instrumentation, temperature element 181, which measures the furnace outlet temperature, and temperature element 186, which measures the furnace bed temperature, both connect to a temperature differential controller 187, which sounds an alarm 188 upon reaching an excessively high or low differential temperature between the two points. Upon reaching a predetermined excessively high or low temperature, temperature differential controller 187 stops the flow of feed by turning off the drive 180. A similar set of instruments and controls is provided, but not shown, for compactor 50 and its drive 55. In this connection, a low temperature in the furnace outlet 51 or 51*a*** indicates probable stoppage of flow; whereas a high temperature in the furnace outlet probably indicates a lack of sufficient feed in the outlet conduit, resulting in an excessive out-leakage of gas from the furnace into the compactor, where continuation of combustion could cause serious damage to the compactor parts. It is to be noted that additional instruments and controls of a conventional nature (not shown) may be provided for both the furnace and the compactors without departing from the invention.

FIGS. 3, 4 and 5 are cross-sectional views based upon FIG. 2, as indicated. The purpose of these three views is to show the manner in which the interior walls of the furnace are shaped so as to allow coarse feed to enter the two furnace outlets at the bottom of the furnace and to channel feed from the furnace preferentially toward these outlets, as well as to enable fine feed to enter the outlets from above without excessive contact with upwardly moving gases from the fluidizing air distributor. More specifically, FIGS. 3, 4 and 5 show the outline of the furnace 70 and the interior of the furnace lining 170. The outlines of gas distributor 73 and the furnace discharge openings 51 are shown in each view, but not in cross section. The cross-sectional view shown in FIG. 3 indicates the fuel injection ports 176. As may be visualized in examining the cross-section views of FIGS. 2, 3, 4 and 5, the vertical zone directly above each furnace outlet is somewhat funnel shaped, so that feeding of material downwardly to the outlet is enhanced. Also, the furnace interior walls are semi-elliptical in shape, for the purpose of causing particles flowing back into the bed from above to enter the bed at different rates, thereby to minimize surging of the bed.

The furnace construction described above is used for heating materials at rates of 700,000 to 2,800,000 BTU per square foot of hearth area, avoiding problems normally associated with such high combustion rates, such as excessive entrainment of feed from the furnace by the off gas, surging of the bed and insufficient material available at the furnace outlet to meet the needs of the briquetting machine.

I claim:

1. A system for heating and hot briquetting feed material consisting of particulate materials ranging in size up to ⅜ inch and in specific gravity up to 5 containing heat-softenable matter and from zero to 100 percent of the fuel needed for heating the material comprising, in combination, a furnace in the form of a fluid bed reactor having an input and an output, a roll-type compactor having an input and an output, means for supplying feed, air and supplementary fuel to the bed, means including a flue at the top of the furnace for conducting away the furnace off gas, a feed conduit connected to the furnace output and the compactor input including means for regulating the feed rate from the furnace to the compactor, and means for discharging the hot briquettes from the compactor, the fluid bed reactor having a heat generating capacity rate of 700,000 to 2,800,000 BTU per square foot of internal horizontal cross section area at its bottom so as to be capable of processing feed material over a reasonably wide range of throughput and having substantial variations in particle size, density, temperature and fuel content.

2. The combination as claimed in claim 1 in which the internal horizontal cross section area within the furnace near its top in the vicinity of the flue is approximately 5–9 times as great as that at the bottom, so that the gas velocity will be reduced sufficiently to enable a high percentage of the particles entrained by the gas from the bed to become de-entrained and fall back into the bed.

3. The combination as claimed in claim 2 in which internal sloping side walls of the furnace connecting the top section to the narrower bottom section slope at different angles around the internal perimeter so as to cause the de-entrained particles to slide downward along the walls at different rates as they return to the bed so that the magnitude of any surges in bed pressure caused by material being blown upward and then sliding back into the bed are minimized.

4. The combination as claimed in claim 2 in which the sloping walls of the furnace are flared steeply outward and upward from the furnace outlet so that the feed material is collected from a substantial zone of the furnace and channelled downward toward the outlet at a sufficient rate to keep the outlet conduit filled and for discharge of the finer materials in the feed substantially free of blowing from the outlet back into the upper part of the furnace by the fluidizing air.

5. The combination as claimed in claim 1 in which at least a portion of the feed containing the finer particle sizes is fed into the bed near its bottom in the vicinity of the outlet to minimize entrainment of fine material from the bed by the fluidizing air.

6. The combination as claimed in claim 1 in which combustible matter is fed into the fluidized bed at a point near the outlet so as to maintain maximum heating and chemically reducing conditions in the vicinity of the outlet so that the feed will be at its highest temperature and most chemically reduced state as it is discharged to the compactor.

7. The combination as claimed in claim 1 in which the furnace product outlet is adjacent the bottom of the bed to reduce the accumulation of larger particles within the bed.

8. The combination as claimed in claim 1 in which the compactor is positioned closely below the bottom of the furnace, so that the nip of the rolls is close to the furnace discharge opening with the feed conduit substantially vertical so as to facilitate gravity feeding of material from the furnace to the compactor and to minimize loss of heat from the material.

9. A system for heating and hot briquetting feed material consisting of particulate materials containing heat-softenable matter comprising, in combination, a furnace in the form of a fluid bed reactor having an input and output and a roll-type compactor having an input and an output, means for supplying feed, air and fuel to the furnace, means for processing the furnace off gases, conduit means for connecting the furnace output to the compactor input, means for discharging the hot briquettes from the compactor, means for controlling the feed rate from the furnace to the compactor, means for sensing the temperature of the interior of the conduit between the furnace and the compactor, and means responsive to the temperature sensing means for acting upon the controlling means for closing the passageway when the temperature is so high as to damage the equipment to which it is exposed or so low as to risk stoppage of flow of feed through the passageway.

10. A system for heating and hot briquetting feed material consisting of particulate materials containing heat-softenable matter comprising, in combination, a furnace in the form of a fluid bed reactor having an input and output and a roll-type compactor having an input and an output, means for supplying feed, air and fuel to the furnace, means for processing the furnace off gases, conduit means for connecting the furnace output to the compactor input, means for discharging the hot briquettes from the compactor, means for controlling the feed rate from the furnace to the compactor, means for sensing the temperature of the interior of the conduit between the furnace and the the compactor, means for sensing the temperature of the furnace bed, means determining the difference between the temperature of the bed and that of the interior of the conduit from the bed to the compactor, and means responsive to the temperature differential determining means for acting upon the controlling means for closing the passageway when the differential temperature indicates that the interior is so much hotter than the bed temperature that the equipment might be damaged or so much lower as to risk stoppage of flow through the passageway.

* * * * *